US008647057B2

(12) United States Patent
Orosa et al.

(10) Patent No.: US 8,647,057 B2
(45) Date of Patent: Feb. 11, 2014

(54) TURBINE EXHAUST DIFFUSER WITH A GAS JET PRODUCING A COANDA EFFECT FLOW CONTROL

(75) Inventors: John Orosa, Palm Beach Gardens, FL (US); Matthew Montgomery, Jupiter, FL (US)

(73) Assignee: Siemens Energy, Inc., Orlando, FL (US)

( * ) Notice: Subject to any disclaimer, the term of this patent is extended or adjusted under 35 U.S.C. 154(b) by 617 days.

(21) Appl. No.: 12/944,177

(22) Filed: Nov. 11, 2010

(65) Prior Publication Data

US 2011/0058939 A1 Mar. 10, 2011

Related U.S. Application Data

(63) Continuation-in-part of application No. 12/476,302, filed on Jun. 2, 2009, now Pat. No. 8,337,153.

(51) Int. Cl.
*F01D 25/24* (2006.01)

(52) U.S. Cl.
USPC ..... 415/182.1; 415/211.2

(58) Field of Classification Search
USPC ..... 415/914, 211.2, 142, 182.1, 224.5
See application file for complete search history.

(56) References Cited

U.S. PATENT DOCUMENTS

| | | | |
|---|---|---|---|
| 2,625,794 | A | 1/1953 | Williams et al. |
| 2,809,491 | A | 10/1957 | Wosika |
| 3,062,006 | A | 11/1962 | Egbert et al. |
| 3,241,316 | A | 3/1966 | Endres |
| 3,374,631 | A | 3/1968 | Marks |
| 3,625,630 | A | 12/1971 | Soo |
| 4,029,430 | A | 6/1977 | Fonda-Bonardi |
| 4,515,524 | A | 5/1985 | Fisher, Jr. |
| 5,462,088 | A | 10/1995 | Poux et al. |
| 5,564,898 | A | 10/1996 | Richards et al. |
| 5,603,605 | A | 2/1997 | Fonda-Bonardi |
| 5,778,658 | A | 7/1998 | Lamando, Jr. et al. |
| 6,390,418 | B1 | 5/2002 | McCormick et al. |
| 6,488,470 | B1 | 12/2002 | Owczarek |

(Continued)

FOREIGN PATENT DOCUMENTS

| | | | |
|---|---|---|---|
| GB | 2415749 | A | 1/2006 |
| JP | 2007303324 | A | 11/2007 |
| WO | 2007019336 | A2 | 2/2007 |

OTHER PUBLICATIONS

Sandra Gunter et al.; A Three-Dimensional CFD Design Study of a Circulation Control Inlet Guide Vane for a Transonic Compressor; Proceedings of ASME Turbo Expo 2009: Power for Land, Sea and Air; GT2009-59360; Jun. 8-12, 2009; Orlando, Florida.

(Continued)

*Primary Examiner* — Dwayne J White

(57) ABSTRACT

An exhaust diffuser system and method for a turbine engine includes an inner boundary and an outer boundary with a flow path defined therebetween. The inner boundary is defined at least in part by a hub structure that has an upstream end and a downstream end. The outer boundary may include a region in which the outer boundary extends radially inward toward the hub structure and may direct at least a portion of an exhaust flow in the diffuser toward the hub structure. The hub structure includes at least one jet exit located on the hub structure adjacent to the upstream end of the tail cone. The jet exit discharges a flow of gas substantially tangential to an outer surface of the tail cone to produce a Coanda effect and direct a portion of the exhaust flow in the diffuser toward the inner boundary.

16 Claims, 9 Drawing Sheets

(56) References Cited

U.S. PATENT DOCUMENTS

| | | | |
|---|---|---|---|
| 6,733,238 | B2 | 5/2004 | Hiyama et al. |
| 6,896,475 | B2 | 5/2005 | Graziosi et al. |
| 7,272,930 | B2 | 9/2007 | Wiebe et al. |
| 7,373,773 | B2 | 5/2008 | Noda |
| 7,549,282 | B2 | 6/2009 | Widenhoefer et al. |
| 7,610,179 | B2 | 10/2009 | Florea et al. |
| 2003/0136102 | A1 | 7/2003 | Nottin |
| 2005/0050898 | A1 | 3/2005 | Noda |
| 2005/0066647 | A1 | 3/2005 | Wiebe et al. |
| 2009/0056340 | A1 | 3/2009 | Woltmann et al. |
| 2009/0263243 | A1 | 10/2009 | Little et al. |

OTHER PUBLICATIONS

U.S. Appl. No. 12/476,302, filed Jun. 2, 2009 entitled "Turbine Exhaust Diffuser Flow Path With Region of Reduced Total Flow Area".

U.S. Appl. No. 12/393,555, filed Feb. 26, 2009 entitled "A Diffuser Apparatus in a Turbomachine".

John Orosa; U.S. patent application entitled "Turbine Exhaust Diffuser With Region of Reduced Flow Area and Outer Boundary Gas Flow" .

TURBINE EXHAUST DIFFUSER WITH A GAS JET PRODUCING A COANDA EFFECT FLOW CONTROL

CROSS-REFERENCE TO RELATED APPLICATION

This application is A CONTINUATION-IN-PART APPLICATION of and claims priority to U.S. patent application Ser. No. 12/476,302, filed on Jun. 2, 2009 now U.S. Pat. No. 8,337,153, entitled "TURBINE EXHAUST DIFFUSER FLOW PATH WITH REGION OF REDUCED TOTAL FLOW AREA," the entire disclosure of which is incorporated by reference herein.

STATEMENT REGARDING FEDERALLY SPONSORED DEVELOPMENT

Development for this invention was supported in part by Contract No. DE-FC26-05NT42644, awarded by the United States Department of Energy. Accordingly, the United States Government may have certain rights in this invention.

FIELD OF THE INVENTION

The invention relates in general to turbine engines and, more particularly, to exhaust diffusers for turbine engines.

BACKGROUND OF THE INVENTION

Referring to FIG. 1, a turbine engine 10 generally includes a compressor section 12, a combustor section 14, a turbine section 16 and an exhaust section 18. In operation, the compressor section 12 can induct ambient air and can compress it. The compressed air from the compressor section 12 can enter one or more combustors 20 in the combustor section 14. The compressed air can be mixed with the fuel, and the air-fuel mixture can be burned in the combustors 20 to form a hot working gas. The hot gas can be routed to the turbine section 16 where it is expanded through alternating rows of stationary airfoils and rotating airfoils and used to generate power that can drive a rotor 26. The expanded gas exiting the turbine section 16 can be exhausted from the engine 10 via the exhaust section 18.

The exhaust section 18 can be configured as a diffuser 28, which can be a divergent duct formed between an outer shell 30 and a center body or hub 32 and a tail cone 34. The exhaust diffuser 28 can serve to reduce the speed of the exhaust flow and thus increase the pressure difference of the exhaust gas expanding across the last stage of the turbine. In some prior turbine exhaust sections, exhaust diffusion has been achieved by progressively increasing the cross-sectional area of the exhaust duct in the fluid flow direction, thereby expanding the fluid flowing therein.

It is preferable to minimize disturbances in the exhaust diffuser fluid flow; otherwise, the performance of the diffuser 28 can be adversely affected. Such disturbances in the fluid flow can arise for various reasons, including, for example, boundary layer separation. If fluid flow proximate a diffuser wall (the boundary layer) separates from the wall, there is a loss in the diffusing area and pressure recovery is reduced. Generally, the larger the angle of divergence in a diffuser, the greater the likelihood that flow separation will occur.

One approach to minimizing flow separation is to provide a diffuser with a relatively long hub. A long hub can maximize performance by delaying the dump losses—flow losses that occur at the downstream end of the hub/tail cone—to a point when the exhaust gases are traveling at a lower velocity, thereby minimizing the strength of the tail cone's wakes in the flow. However, a long hub presents a disadvantage in that it can make the engine design more complicated and expensive. For instance, a longer hub typically requires two rows of support struts 36—one in an upstream region of the hub 32 and one in a downstream region of the hub 32, as shown in FIG. 1. These support struts 36 can increase cost and the risk of material cracking due to thermal mismatch between inner and outer flowpath parts or vibratory loads. Further, long hubs can pose challenges in instances where available space is limited.

Another approach to minimizing flow separation losses is to provide a diffuser with a relatively short hub length followed by a reduced divergence angle. This approach can minimize cost by, among other things, requiring only a single row of support struts. However, diffuser performance may suffer because this design can often lead to high dump losses from having the hub end (sudden expansion) further upstream in the diffuser where the flow velocities are higher. To avoid a second set of struts, associated tail cones are often steep, causing wakes to form in the flow downstream of the tail cone which can continue to grow downstream.

Thus, there is a need for an exhaust diffuser that can achieve the performance benefits of a long hub design while enjoying the reduced cost and risk of a short hub design.

SUMMARY OF THE INVENTION

In accordance with an aspect of the invention, an exhaust diffuser for a turbine engine may be provided comprising an inner boundary and an outer boundary. The outer boundary may be defined by a diffuser shell, the outer boundary being radially spaced from the inner boundary so that a flow path for guiding an exhaust flow is defined therebetween. The outer boundary contains a radially inwardly extending region in which the outer boundary extends radially inwardly toward the inner boundary. At least one gas jet may be provided including a jet exit located on the inner boundary, upstream from a downstream end of the inner boundary. The jet exit may discharge a flow of gas downstream substantially parallel to an outer surface of the inner boundary to direct a portion of the exhaust flow in the diffuser toward the inner boundary.

The inner boundary may comprise a tail cone including a radially inwardly curved surface, and the flow of gas from the jet exit may produce a Coanda effect to entrain and accelerate a portion of the exhaust flow to turn radially inwardly, resulting in substantially attached flow around the curvature of the tail cone.

In accordance with another aspect of the invention, an exhaust diffuser for a turbine engine may be provided comprising an inner boundary defined by a hub structure comprising at least a hub and a tail cone. The hub may include an upstream end and a downstream end. The tail cone may include an upstream end located adjacent the downstream end of the hub and include a downstream end, and the tail cone may taper radially inwardly toward an axis of the diffuser. An outer boundary may be defined by a diffuser shell, the outer boundary being radially spaced from the inner boundary so that a flow path is defined therebetween. The outer boundary may have a region in which the outer boundary extends radially inwardly toward the inner boundary, wherein the region begins at a point that is one of substantially aligned with and proximately upstream of the downstream end of the hub structure. The outer boundary may direct at least a portion of an exhaust flow in the diffuser toward the hub structure. At least one gas jet may be provided including a jet exit located on the hub structure adjacent to the upstream end of the tail cone. The jet exit may discharge a flow of gas downstream substantially parallel to an outer surface of the tail cone to direct an additional portion of the exhaust flow toward the hub structure. The flow of gas from the jet exit may entrain and direct the additional portion of exhaust flow via a Coanda effect.

In accordance with a further aspect of the invention, a method of exhaust diffusion in a turbine engine is provided comprising the steps of: providing a turbine engine having a turbine section and an exhaust diffuser section, the exhaust diffuser section including an inner boundary defined at least by a hub structure comprising at least a hub and a tail cone, the hub having an upstream end and a downstream end, the tail cone having an upstream end located adjacent the downstream end of the hub and a downstream end, and the tail cone tapering radially inwardly toward an axis of the diffuser, the exhaust diffuser section further including an outer boundary radially spaced from the inner boundary so that a flow path is defined therebetween, the outer boundary comprising a region in which the outer boundary extends radially inwardly toward the inner boundary; supplying turbine exhaust gas flow to the flow path; the region of the outer boundary directing at least a portion of the exhaust flow toward the hub structure; and providing a Coanda jet flow adjacent the upstream end of the tail cone to effect a radially inward flow of at least a portion of the exhaust gas flow toward the tail cone.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiment, reference is made to the accompanying drawings that form a part hereof, and in which is shown by way of illustration, and not by way of limitation, a specific preferred embodiment in which the invention may be practiced. It is to be understood that other embodiments may be utilized and that changes may be made without departing from the spirit and scope of the present invention.

Embodiments of the invention are directed to an exhaust diffuser system, which can increase the power and efficiency of a turbine engine. Aspects of the invention will be explained in connection with various possible configurations, but the detailed description is intended only as exemplary. Embodiments of the invention are shown in FIGS. 2-8 and 8A, but the present invention is not limited to the illustrated structure or application.

Figure 1:
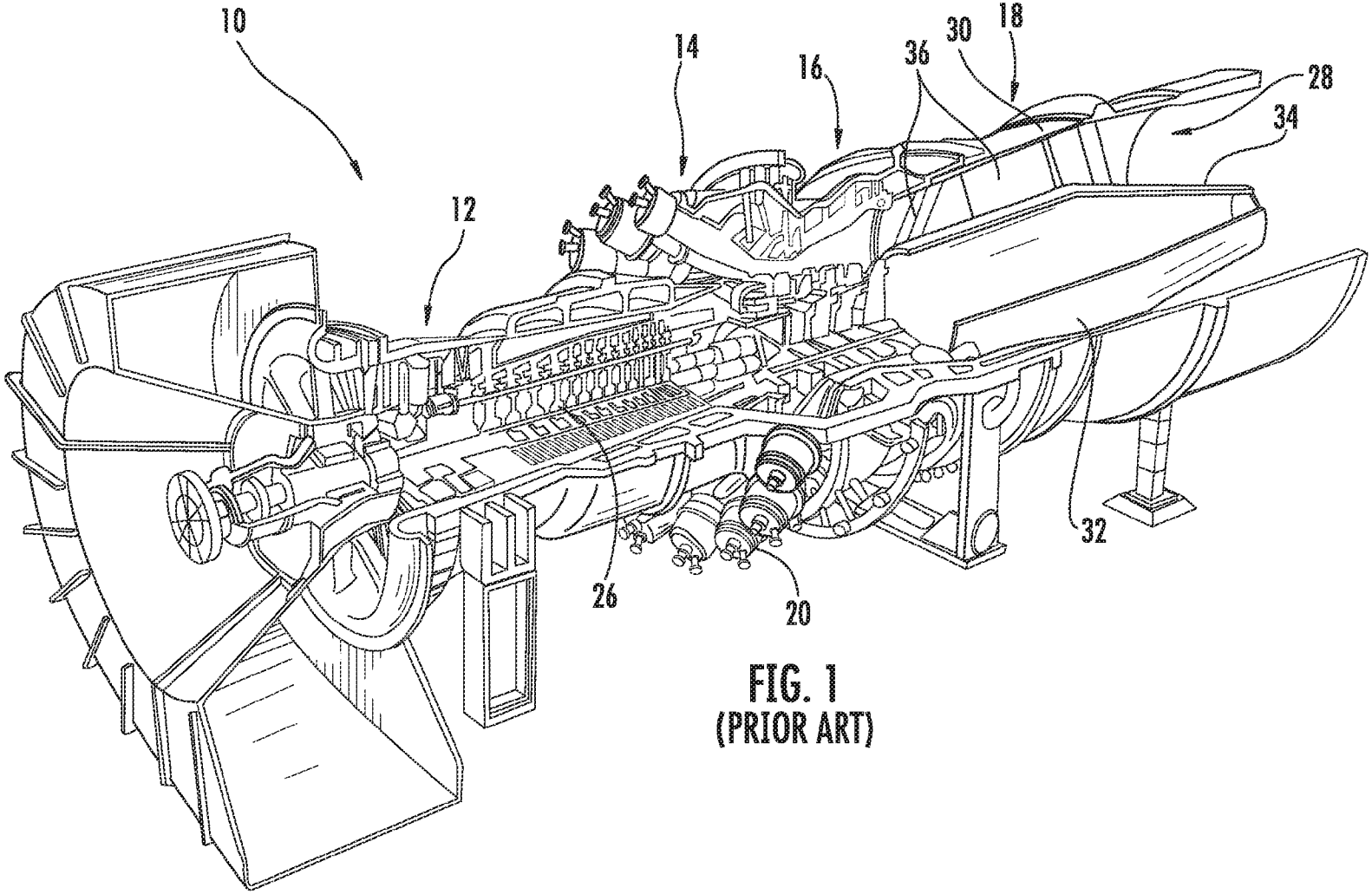
FIG. 1 (PRIOR ART)
FIG. 1 is a perspective view partially in cross-section of a known turbine engine.
Figure 2:
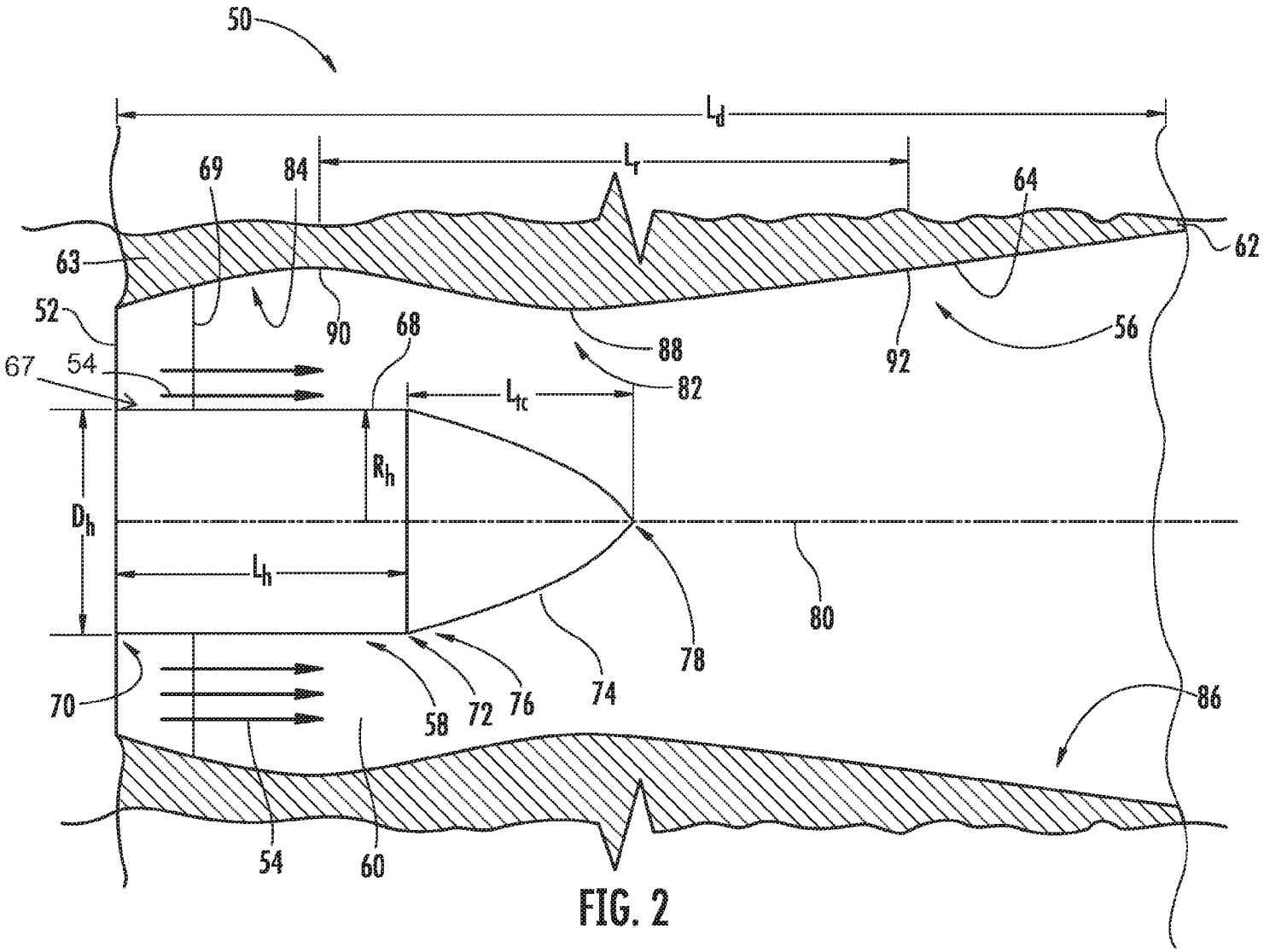
FIG. 2 is a side elevation cross-sectional view of an exhaust diffuser section of a turbine engine configured in accordance with aspects of the invention.

FIG. 2 shows a portion of the exhaust diffuser section 50 of a turbine engine configured in accordance with aspects of the invention. The exhaust diffuser section 50 is downstream of and in fluid communication with the turbine section (not shown) of the engine. The exhaust diffuser 50 has an inlet 52 that can receive gases 54 exiting from the turbine section. The exhaust diffuser section 50 can include an outer boundary 56 and an inner boundary 58. The outer boundary 56 is radially spaced from the inner boundary 58 such that a flow path 60 is defined between the inner and outer boundaries 56, 58. The flow path 60 can be generally annular or can have other suitable conformation. At least a portion of the flow path 60 can be generally conical.

The outer boundary 56 can be defined by a diffuser shell 62. The diffuser shell 62 can include an inner peripheral surface 64. The inner peripheral surface 64 can define the outer boundary 56 of the flow path 60. The diffuser shell 62 can define the axial length $L_d$ (only a portion of which is shown in FIG. 2) of the exhaust diffuser 50. The axial length $L_d$ can extend from an upstream end 63 of the diffuser shell 62 to a downstream end 65 of the diffuser shell 62 (see FIG. 4).

The inner boundary 58 can be defined by a center body, also referred to as a hub structure 67 comprising a hub 68 and a tail cone 74. The hub 68 can be generally cylindrical. The hub 68 can include an upstream end 70 and a downstream end 72. The terms "upstream" and "downstream" are intended to refer to the general position of these items relative to the direction of fluid flow through the exhaust diffuser section 50. The hub 68 can be connected to the diffuser shell 62 by a plurality of support struts 69, which can be arranged in circumferential alignment in a row.

The hub 68 can have an associated axial length $L_h$, radius $R_h$ and diameter $D_h$. An exhaust diffuser section configured according to aspects of the invention can have a shorter axial length compared to prior designs. In one embodiment, the axial length $L_h$ of the hub 68 can be about 2.2 to about 2.4 times the hub radius $R_h$. Because of its axial compactness, the hub 68 may only need to be supported by a single row of support struts 69. The axial length $L_h$ of the hub 68 can be from about 10 percent to about 12 percent of axial length $L_d$ of the exhaust diffuser 50. However, it should be noted that in accordance with a further aspect of the invention associated with Coanda effect flow control, described below with reference to FIGS. 8 and 8A, a longer hub and additional support struts may be provided.

As noted above, the inner boundary 58 is partially defined by the tail cone 74. The tail cone 74 can have an upstream end 76 and a downstream end 78. The tail cone 74 can have an associated axial length $L_{tc}$. The tail cone 74 can be attached to the downstream end 72 of the hub 68 in any suitable manner. The hub 68 and the tail cone 74 can be substantially concentric with the diffuser shell 62 and can share a common longitudinal axis 80.

Preferably, the tail cone 74 tapers from the upstream end 76 to the downstream end 78 in as short of an axial distance as possible. In one embodiment, the axial length $L_{tc}$ of the tail cone 74 can be from about 1 to about 2 times the hub radius $R_h$. More particularly, the axial length $L_{tc}$ of the tail cone 74 can be about 1.5 to about 2 times the hub radius $R_h$. Alternatively or in addition, the axial length $L_{tc}$ of the tail cone 74 can be about 70 to about 85 percent of the axial length $L_h$ of the hub 68. However, it should be understood that the present embodiment is not limiting to other aspects of the invention described herein. For example, in accordance with further aspects of the invention discussed below with reference to FIGS. 5-8 and 8A, the dimensions of the tail cone relative to the hub may be different than those described for the present embodiment to obtain alternative performance advantages.

According to aspects of the invention, the outer boundary 56 can be configured to direct at least a portion of the exhaust flow 54 toward the hub 68. To that end, outer boundary 56, such as diffuser shell 62, can be configured to achieve such a result. For instance, the outer boundary 56 can include a region 82 that extends generally radially inwardly toward the hub 68. The term "radially" and variants thereof are used herein to mean relative to the longitudinal axis 80. The region 82 can be formed in any suitable manner. For instance, the region 82 can be formed by one or more contours in the inner peripheral surface 64, by a protrusion extending from the inner peripheral surface 64, and/or by a separate piece attached to the inner peripheral surface 64 in any suitable manner. The region 82 can extend circumferentially or otherwise peripherally about the inner peripheral surface 64 of the diffuser shell 62. The outer boundary 56 can initially include an initial diverging region 84 that transitions into the radially inwardly extending region 82, which can later transition into a second diverging region 86.

The radially inwardly extending region 82 can have any suitable conformation. In one embodiment, the region 82 can have a generally semi-circular cross-sectional profile. Alternatively, the region 82 can have a generally semi-elliptical, generally parabolic, generally triangular, generally trapezoidal or generally semi-polygonal cross-sectional profile, just to name a few possibilities. The region 82 can have curved or rounded features or rounded edges to minimize flow disruptions.

The region 82 can have an associated beginning point 90. It will be understood that the beginning point 90 of the region 82 is the point at which the outer boundary 56 starts to move radially inward toward the inner boundary 58. In one embodiment, the region 82 can begin at a point that is substantially aligned with the downstream end 72 of the hub 68. Alternatively, the region 82 can begin at a point that is proximately upstream of the downstream end 72 of the hub 68. For instance, the region 82 can begin upstream of the downstream end 72 of the hub 68 within a distance of less than about one half of the hub diameter $D_h$ from the downstream end 72 of the hub 68.

The outer boundary 56 can continue to move radially inward toward the inner boundary 58 until a radially innermost point 88 of the region 82 is reached. In one embodiment, the radially innermost point 88 of the region 82 can be substantially aligned with the downstream end 78 of the tail cone 74. Alternatively, the radially innermost point 88 of the region 82 can be proximately upstream of the downstream end 78 of the tail cone 74. For instance, the radially innermost point 88 of the region 82 can be upstream of the downstream end 78 of the tail cone 74 within a distance of less than about one half of the length $L_{tc}$ of the tail cone 74. Alternatively or in addition to the above, the radially innermost point 88 of the region 82 can be downstream of the downstream end 72 of the hub 68 within a distance of less than about 1 to about 1.5 times the hub diameter $D_h$.

The reduction in diameter of the outer boundary 56 from the beginning 90 of the region 82 to the radially innermost point 88 of the region can be from about 10 to about 20 percent. In one embodiment, the diameter of the outer boundary 56 at the radially innermost point 88 of the region 82 can be substantially equal to the diameter of the outer boundary 56 at the exhaust diffuser inlet 52. In another embodiment, the diameter of the outer boundary 56 at the radially innermost point 88 of the region 82 can be less than the diameter of the outer boundary 56 at the exhaust diffuser inlet 52.

The overall axial length $L_r$ of the region 82 can be from about 2 to about 3 times the hub diameter $D_h$. More particularly, the overall axial length $L_r$ of the region 82 can be about 2.5 times the hub diameter $D_h$. The axial length $L_r$ of the region 82 is the axial distance between the beginning point 90 of the region 82, as described above, and the ending point 92 of the region 82, which can be the point at which the outer boundary 56 returns to the same diameter that it had at the beginning point 90 of the region 82.

Figure 3:
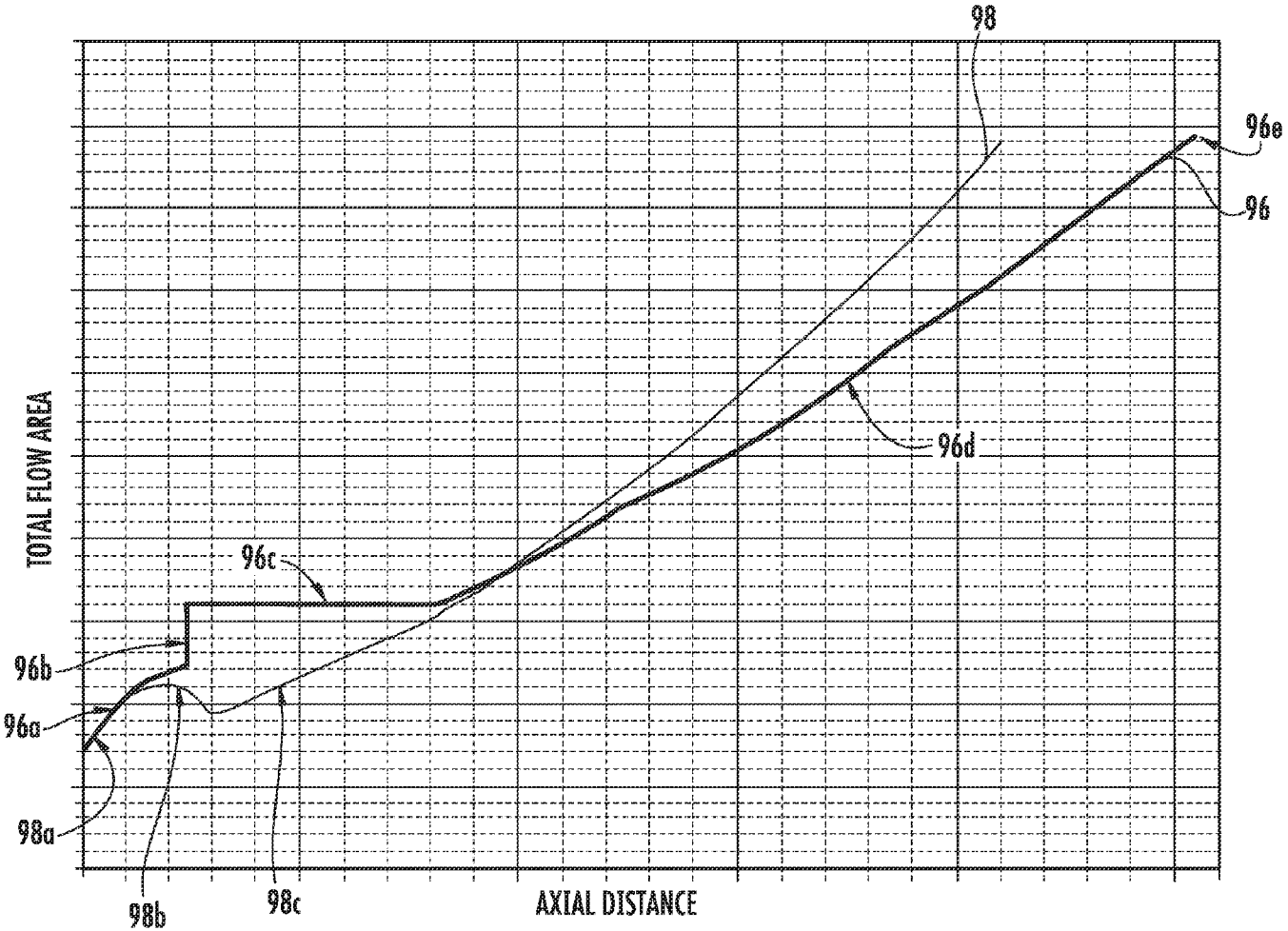
FIG. 3 is a graph showing the variation in the total flow area of an exhaust diffuser flow path along the axial length of an exhaust diffuser section, comparing one embodiment of an exhaust diffuser section configured in accordance with aspects of the invention to a known exhaust diffuser section.

The flow path 60 can have an associated flow area that varies over the axial length $L_d$ of the exhaust diffuser 50. FIG. 3 shows one example of how the total area of the exhaust diffuser flow path 60 can change along the axial length $L_d$ of the exhaust diffuser 50. More particularly, FIG. 3 graphically depicts the total flow area profile along the axial length of the exhaust diffuser, comparing the profile of one embodiment of an exhaust diffuser according to aspects of the invention, shown at 98, to the profile of a known exhaust diffuser design, shown at 96. FIG. 3 is presented as dimensionless because the actual dimensions will vary depending on the particular system and application and further because it is the relative ratios and/or percentages between various features and/or attributes of the components that are of significance.

Referring to profile 96, it can be seen that in a prior exhaust diffuser there was an initial expansion of flow area 96*a*. The total flow area dramatically increases in a region 96*b*, which coincides with the end of the inner boundary and remains at a constant total flow area 96*c* for some distance. This constant flow area 96*c* is indicative that the diameter of the outer boundary is held constant for a certain length in order to allow wakes that form in the flow downstream of the end of the hub to be resolved before continuing the diffusion. The region of constant flow area 96*c* transitions into a region 96*d* in which the total flow area progressively increases until the downstream end 96*e* of the diffuser is reached.

In contrast, profile 98 of an exhaust diffuser configured according to aspects of the invention includes an initial region of expanding total flow area 98*a*, which transitions to a region 98*b* in which the flow area decreases. As noted above, region

98*b* can correspond with the beginning of the radially inwardly extending region 82 of the outer boundary 56. Having a region of reduced flow area 98*b* at the end of the tail cone 74 and/or hub 68 can help to minimize wake formation in the flow. The region of reduced flow area 98*b* can transition to a region in which the flow area increases 98*c*. The reduced flow area region 98*b* can allow the outer boundary to have a more aggressive diffusion angle, which results in an appreciably greater total flow area. As shown in FIG. 3, the difference in flow area between the prior and proposed designs can be significant, particularly in the far downstream regions.

Because the outer boundary 56 of the flow path 60 moves radially inward in the region 82, the total flow area of the flow path 60 can be maintained or reduced at or near the downstream end 72 of the hub 68 or the tail cone 74. In one embodiment, the total flow area can be reduced by about 10 percent near the tail cone 74 before it begins to increase again. The exact amount and location of the flow area reduction can be tailored to the flow conditions prevalent in the particular application. For example, the diffuser inlet velocity distribution in the radial direction can have an impact on the tendency of the flow along the hub to separate, which will in turn affect the amount of flow path pinching necessary to maintain an acceptable level of hub flow.

Now that the individual components of the exhaust system according to aspects of the invention have been described, one manner in which the system can operate will be explained. During engine operation, gases 54 exiting the turbine section of the engine are passed through the exhaust diffuser 50. As the gases 54 encounter the region, the outer boundary 56 can direct at least a portion of the exhaust flow 54 toward the hub 68. The reduced total flow area can help to accelerate the exhaust flow on the tail cone 74 and can further reduce the likelihood of flow separation or dump losses at the end of the hub and increased pressure loss. Increasing flow velocity at the downstream end 72 of the hub 68 allows its flow path shape (tail-cone) to be tapered quickly to a small radius and truncated in a short distance without any significant flow separations.

With relatively lower hub losses, it may be possible to increase the expansion angle of the exhaust diffuser 50 downstream of the region 82. In one embodiment, the angle can be at about 6 degrees relative to the longitudinal axis 80. An increased diffuser angle can help to achieve a shorter overall length of the diffuser section $L_d$. For instance, it is estimated that the overall reduction in length $L_d$ of the exhaust diffuser 50 can be about 15-20% compared to prior designs.

Figure 4:
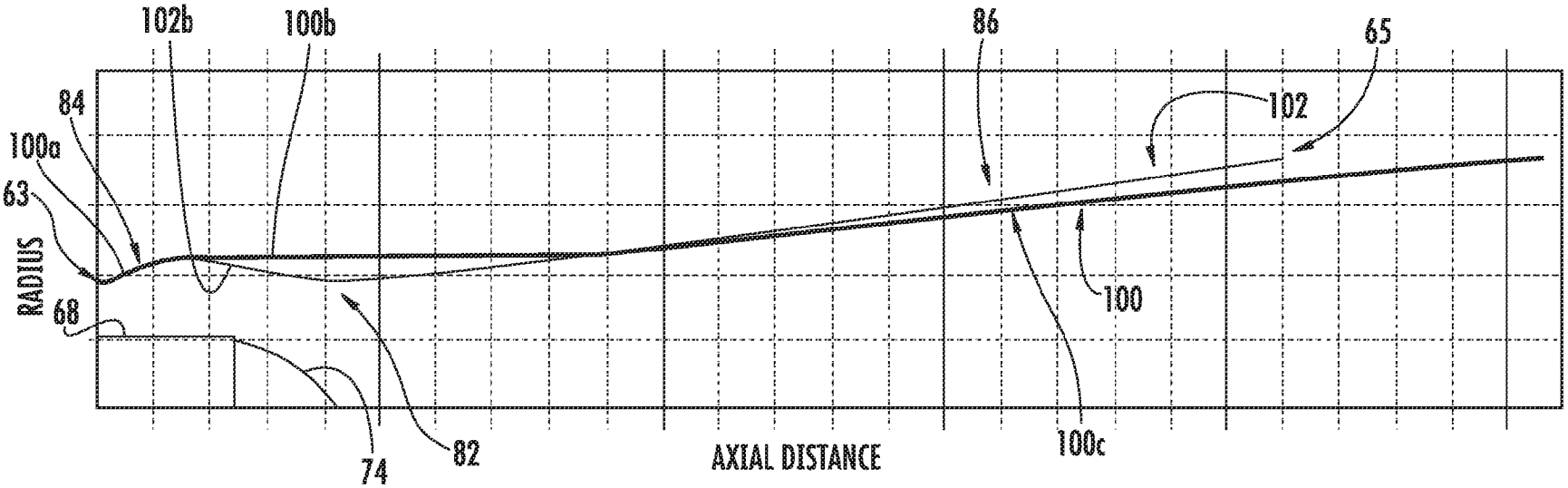
FIG. 4 is a graph of the profile of an inner boundary and an outer boundary of an exhaust diffuser flow path along the axial length of an exhaust diffuser section, comparing one embodiment of the outer boundary profile of an exhaust diffuser section configured in accordance with aspects of the invention to the outer boundary profile of a known exhaust diffuser section.

FIG. 4 shows some of the potential differences in outer boundary profile, axial length and divergence angle between an exhaust diffuser configured according to aspects of the invention and known exhaust diffusers. It is noted that FIG. 4 is presented as dimensionless because the actual dimensions will vary depending on the particular system and application and further because it is the relative ratios and/or percentages between features or attributes of the components that are of significance. The outer boundary profile of a known exhaust diffuser is shown at 100; an outer boundary profile of an exhaust diffuser configured in accordance with aspects of the invention is shown at 102.

Both profiles 100, 102 begin with an initially diverging region 100*a*, 84, respectively. The initial region 100*a* of the known diffuser transitions to a region of a constant radius 100*b*, whereas, in contrast, the initial region 84 of a diffuser configured according to aspects of the invention transitions to the radially inwardly extending region 82. The region 82 transitions to the second diverging region 86, while, at this same point, the profile 100 of the known diffuser is still configured as a constant radius region 100*b*. Eventually, the constant radius region 100*b* of the known diffuser transitions to an expanding radius region 100*c*. However, it can be readily seen that the expansion angle of the exhaust diffuser according to aspects of the invention is more aggressive than the expansion angle of the known design, thereby achieving sufficient diffusion in a shorter distance so as to permit a short diffuser overall.

Figure 5:
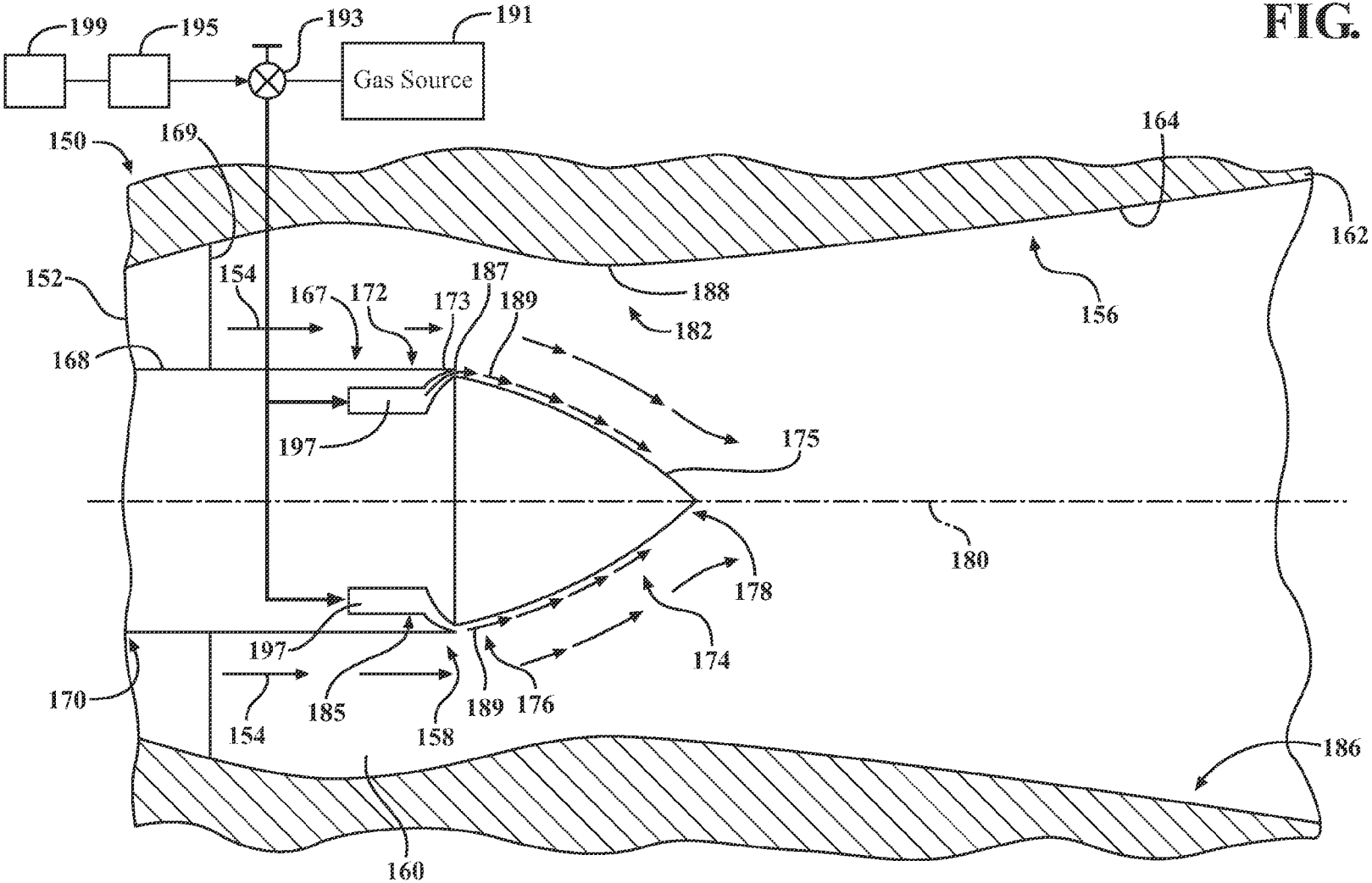
FIG. 5 is a side elevation cross-sectional view of an exhaust diffuser section of a turbine engine configured in accordance with aspects of the invention, including an inner boundary comprising a Coanda jet.
Figure 6:
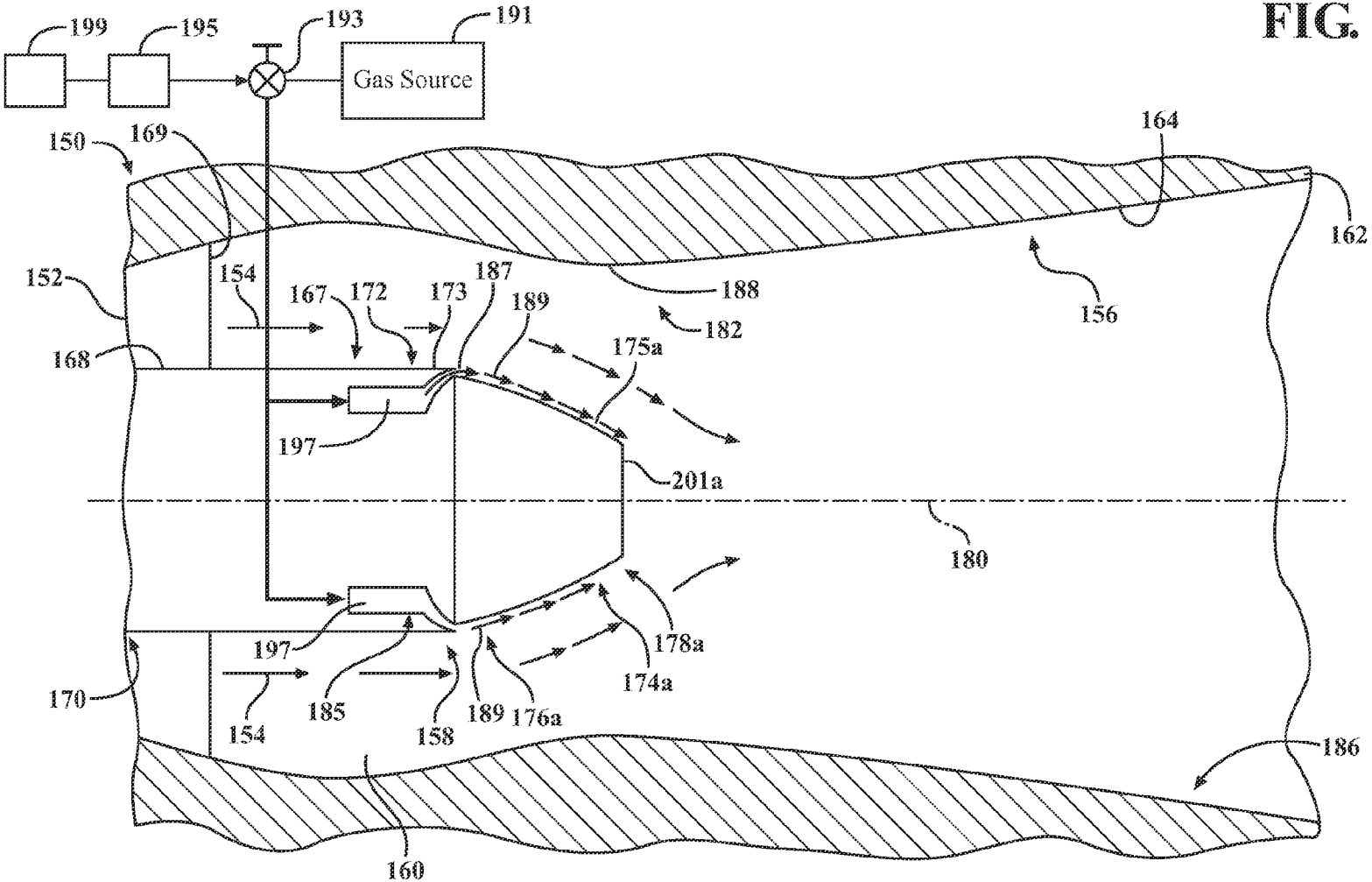
FIG. 6 is a side elevation cross-sectional view of an exhaust diffuser section of a turbine engine configured in accordance with aspects of the invention, including an inner boundary comprising an alternative configuration for a Coanda jet.
Figure 7:
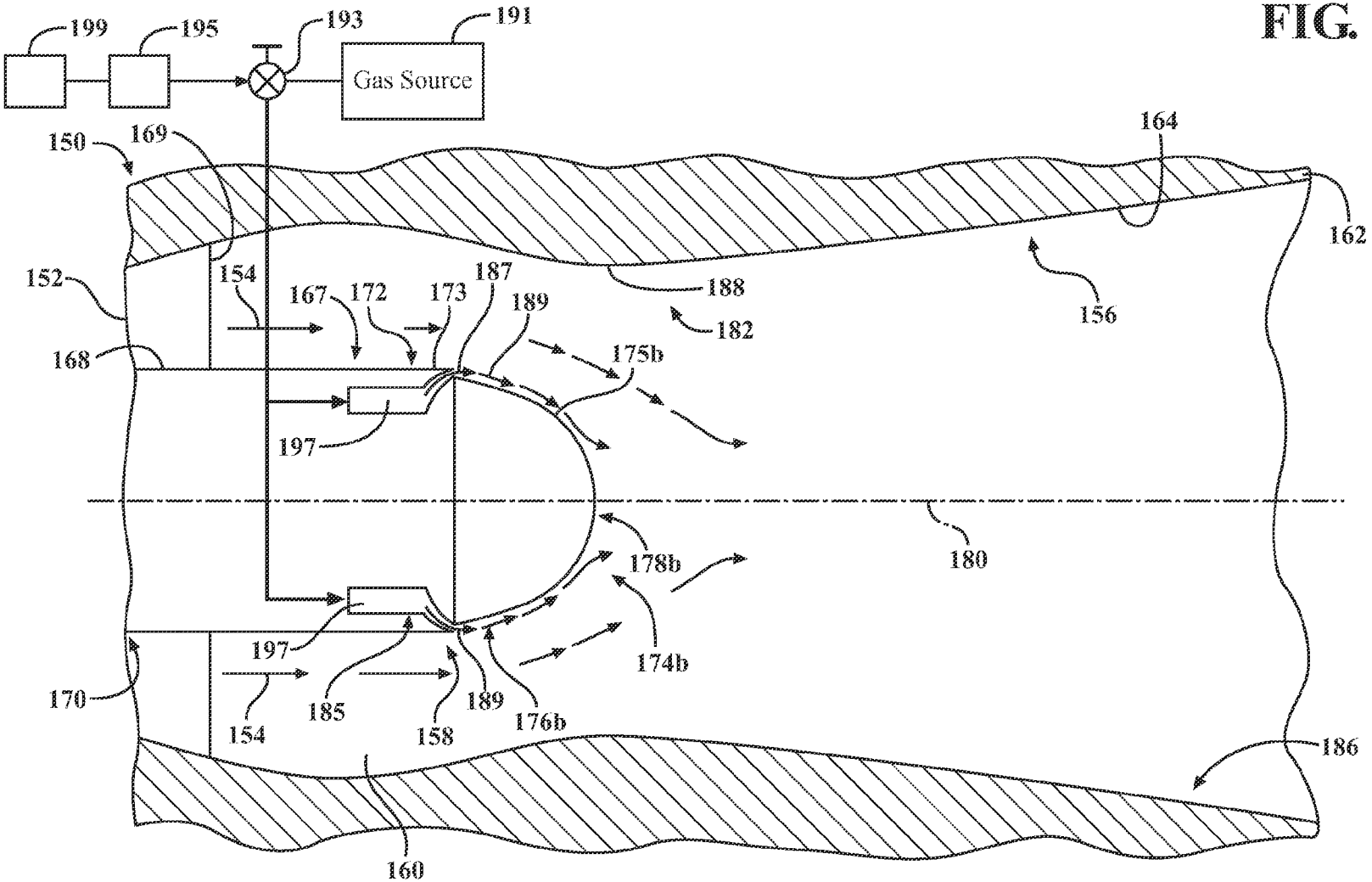
FIG. 7 is a side elevation cross-sectional view of an exhaust diffuser section of a turbine engine configured in accordance with aspects of the invention, including an inner boundary comprising a further alternative configuration for a Coanda jet.

FIGS. 5-7 illustrate an additional aspect of the invention, in which elements corresponding to previously described aspects are labeled with the same reference numeral increased by 100.

Referring to FIG. 5, an exhaust diffuser section 150 of a turbine engine is illustrated and includes an inlet 152 for receiving gases exiting from the turbine section of the engine. The diffuser section 150 further comprises an outer boundary 156 defined by a diffuser shell 162, and an inner boundary 158 defined by a center body, also referred to as a hub structure 167, comprising a hub 168 and a tail cone 174. A flow path 160 is defined between the outer boundary 156 and the inner boundary 158. The outer boundary 156 can have a configuration to direct at least a portion of the exhaust gas radially inwardly toward the hub structure 167, as described above with regard to the outer boundary 56.

The hub structure 167 may have a generally cylindrical cross-section. Further the hub 168 may include an upstream end 170 and a downstream end 172, and the tail cone 174 may include an upstream end 176 located adjacent to the downstream end 172 of the hub 168 and include a downstream end 178. The tail cone 174 may comprise a shape that tapers radially inwardly toward an axis 180 of the diffuser section 150. In accordance with an aspect of the invention, an outer surface of the tail cone 174 may be defined by a slope relative to the axis 180 of the diffuser section 150 that increases extending in a direction from an upstream end to a downstream end of the tail cone 174. For example, the tail cone 174 may comprise a radially inwardly curved surface 175, wherein the surface 175 may comprise an outwardly convex shape, extending from the upstream end 176 to the downstream end 178 of the tail cone 174. The upstream end 170 of the hub 168 and the downstream end 178 of the tail cone 174 further correspond to the upstream and downstream ends of the hub structure 167.

As discussed above with regard to aspects of the outer boundary 56, the outer boundary 156 may include a region 182 in which the outer boundary 156 extends radially inwardly toward the inner boundary 158. The region 182 may begin at a point that is one of substantially aligned with and proximately upstream of the downstream end 178 of the hub structure, whereby the outer boundary 156 directs at least a portion of the exhaust flow 154 in the diffuser section 150 toward the hub structure 167.

In accordance with a particular aspect of the hub structure 167, at least one gas jet 185 may be provided on the hub structure 167, the gas jet 185 may include a jet exit 187 located on the hub structure 167 adjacent to the upstream end 176 of the tail cone 174. For example, the jet exit 187 may be formed by an end section of the downstream end of the hub 168, such as by a lip portion 173 having a diameter greater than the diameter of the surface 175 at the upstream end 176 of the tail cone 174. The jet exit 187 is oriented to discharge a centerbody gas flow 189 downstream substantially parallel to the outer surface 175 of the tail cone 174 to cause an additional portion of the exhaust flow 154 to be directed toward the hub structure 167. The gas jet 187 receives a flow of gas, such as air, from a gas source 191 which is configured to supply the centerbody gas flow 189 at a predetermined pressure to jet exit 187. The gas source 191 may be any supply of gas including, for example, a bleed off of air from the compressor section of the turbine, combustion gas from further downstream in the diffuser, and/or a separate supply of gas external to the turbine engine. The mass flow of the centerbody gas flow 189 from the gas source 191 may be varied, depending on predetermined operating conditions, such as by control of a valve 193 which may be controlled by a system controller 195 for the turbine engine, as described further below.

The centerbody gas flow 189 from the gas source 191 may be provided to an annular chamber 197 extending circumferentially within the hub structure 167. Further, the jet exit 187 may comprise an annular slot extending around the circumference of the hub structure 167, and in fluid communication with the annular chamber 197, to provide a substantially uniform centerbody gas flow 189 out of the jet exit 187 to the surface 175 of the tail cone 174. Alternatively, the jet exit 187 may comprise a plurality of jet exit openings and/or the annular chamber 197 may comprise a plurality of chambers for supplying the centerbody gas flow 189 to the jet exit 187. Preferably, the centerbody gas flow 189 is uniformly distributed around the circumference of the tail cone surface 175.

The jet exit 187 preferably comprises a jet producing a Coanda effect to entrain and accelerate a portion of the exhaust flow 154 to turn radially inwardly in substantially attached flow around the curvature of the tail cone 174. As used herein, "Coanda effect" refers to the effect observed by Henri Coanda in the 1930's of the tendency of a relatively high speed jet of fluid flowing tangentially along a curved or inclined surface to follow the surface along the curve or incline. In accordance with an aspect of the invention, the centerbody gas flow 189 comprises a high speed flow of gas out of the jet exit 187 at or proximate to a location where the surface 175 of the tail cone 174 turns radially inwardly extending in the direction of the downstream end 178 of the tail cone 174. The jet exit 187 is configured to direct the centerbody gas flow 189 in a downstream longitudinal or axial direction that is preferably initially substantially parallel to the axis 180 of the diffuser section 150 or extending at an angle radially inwardly toward the axis 180, depending on the local orientation of the surface 175, to direct a thin jet formed by the centerbody gas flow 189 substantially tangent to the tail cone surface 175 at the upstream end 176 of the tail cone 174 adjacent to the jet exit 187. That is, a thin jet sheet formed by the centerbody gas flow 189 flows out of the jet exit 187 generally parallel to the exhaust flow 154 and tangential to the adjacent tail cone surface 175. Attachment of the jet sheet to the tail cone surface 175 may be maintained due to a balance between centrifugal forces around the curved surface and the sub-ambient pressure in the jet sheet. As the Coanda jet pressure is increased across the jet exit 187, the turning performance of the thin jet sheet to flow along the inwardly extending contour of the tail cone 174 increases. The mass flow of gas provided by the centerbody gas flow 189 from the jet exit 187 may be in a range from about 1% to about 4% of the mass flow of gas comprising the exhaust flow 154 passing through the flow path 160. Further, the centerbody gas flow 189 from the jet exit 187 is preferably discharged at a velocity that is greater than a velocity of the exhaust flow 154 in the diffuser section 150 flowing adjacent to the tail cone 174.

In accordance with aspects of the invention, the flow path 160 has an associated total flow area that varies along a length of the diffuser section 150, and the total flow area may decrease along at least a portion of the tail cone 174, causing at least a portion of the exhaust flow 154 to be directed radially inwardly toward the hub structure 167 and, in particular, toward the tail cone 174. Alternatively, the total flow area may be substantially constant or increasing along the tail cone 174, as the decrease in cross-sectional area of the outer boundary 156 generally may be offset by the radial inward curvature of the tail cone 174. Further, the Coanda effect produced by the gas flow 189 out of the jet exit 187 functions to entrain at least a portion of the exhaust flow 154 and cause the flow to follow the contour of the tail cone 174 radially inwardly, which may effect an increase in the strength of the flow along the hub section 167 for effecting an improved closure of the wake at the downstream end 178 of the tail cone 174. Hence, the improved flow following the contour of the tail cone 174 may permit a further increase in the angle of the second diverging region 186, to achieve a reduction in the overall length of the diffuser section 150. Additionally, incorporating the jet exit 187 to produce the Coanda effect on the tail cone 174 may permit the diffuser section 150 to be designed with less of a reduction in total flow area provided by the inwardly extending region 182 in that the increased strength of flow along the hub structure 167, as created by the Coanda effect, will operate to cause an increase in the radial inward component of the exhaust flow 154 direction.

In accordance with a further aspect associated with the centerbody gas flow 189 provided from the jet exit 187, the strength of the Coanda effect may be adjusted or varied to optimize the performance of the turbine engine with varying operating conditions, such as varying turbine exhaust gas flow conditions. As the gas flow 189 entrains exhaust flow 154 adjacent to the hub structure 167, the exhaust flow 189 passing through the flow path 160 may be drawn radially inwardly. To avoid creating a separation of the exhaust flow 154 at the second diverging region 186 of the outer boundary 156, it may be necessary to decrease the centerbody gas flow 189 in order to decrease the influence of the Coanda effect in drawing the exhaust flow toward the hub structure 167. That is, under certain operating conditions, an exhaust gas flow condition may exist corresponding to a non-uniform velocity profile of the exhaust flow 154, or velocity profile of reduced uniformity, between the inner and outer boundaries 156, 158.

For example, as the inlet temperature of the air entering the turbine engine changes, such as an ambient air temperature that may be measured at a sensor 199, the tendency of the exhaust flow 154 to flow radially inwardly along the tail cone surface 175 may vary and cause a less uniform velocity profile of the exhaust flow 154 radially between the outer boundary 156 and the inner boundary 158. Accordingly, the pressure, and an associated effect on the mass flow rate or velocity of the centerbody gas flow 189 from the jet exit 187, may be adjusted to provide a predetermined flow along the hub structure 167 with an associated affect on the inward flow of a portion of the exhaust flow 154. In particular, when the inlet temperature is lower, e.g., on colder days, the exhaust flow 154 will tend to have more flow towards the inner boundary 158 versus the outer boundary 156, i.e., have a greater tendency to follow the contour of the tail cone 174, and the controller 195 may control the valve 193 to reduce the centerbody gas flow 189 through the jet exit 187 to provide the required Coanda effect for reducing the wake downstream of the hub structure 167. On the other hand, for warmer inlet temperatures, e.g., on hotter days, it may be desirable to increase the centerbody gas flow 189 through the jet exit 187 to increase the Coanda effect for drawing the exhaust flow toward the hub structure 167. In addition, during off-design conditions, due either to changes in ambient temperature or a change in the power output of the turbine engine, the flow will also tend to have more swirl than at design conditions, with a corresponding non-uniform velocity profile of the exhaust gas flow between the outer boundary 156 and the inner boundary 158. The swirl will act to pull flow away from the hub which would then require a stronger Coanda jet to compensate for this. Hence, the controller 195 may operate to automatically change the Coanda effect provided by the jet exit 187 to optimize the flow characteristics through the diffuser section 150 to improve the efficiency of the turbine engine by effecting a variation in the affect of the inner boundary 158 formed by the hub structure 167 relative to the affect of the outer boundary 156 while operating with a fixed geometry for the inner and outer boundaries 156, 158.

Referring to FIG. 6, an alternative configuration for the aspects of the invention described with reference to FIG. 5 is illustrated. In the configuration of FIG. 6, a tail cone 174*a* is provided having a configuration similar to that described for the tail cone 174 in FIG. 5, but includes a truncated downstream end 178*a* having a truncated end surface 201*a*, illustrated as a generally planar surface, extending orthogonal to the diffuser axis 180. For example, the truncated downstream end 178*a* may be generally located at an axial location corresponding to the radially innermost point 188 of the region 182. The turbine exhaust flow is directed radially inwardly by the region 182 to an area of minimum area of the turbine exhaust flow. The axial location of the minimum area of the turbine exhaust flow will not necessarily coincide with the axial location of the region 182, and the downstream end 178*a* may be located at an axial location generally corresponding to the location of the minimum area of the turbine exhaust flow.

The centerbody gas flow 189 may operate to draw the exhaust flow 154 radially inwardly as it flows along the inclined or curved surface 175*a* from the upstream end 176*a* toward the downstream end 178*a*, as described above with reference to FIG. 5. As the flow reaches the downstream end 178*a*, the truncated tail cone 174*a* may permit the influence of the centerbody flow 189 to terminate as the centerbody flow 189 detaches from the hub structure 167 at a predetermined location in order to avoid adversely affecting the divergence of the exhaust flow at the second diverging region 186 of the outer boundary 156. The truncated shape also acts to fix the location of flow separation under a range of diffuser inlet flow conditions, resulting in a more consistent and predictable diffuser behavior. It should be noted that the truncated end surface 201*a* may have an alternative configuration such as a configuration comprising a curvature or incline extending across the downstream end 178*a*.

Referring to FIG. 7, a further alternative configuration for the aspects of the invention described with reference to FIG. 5 is illustrated. In the configuration of FIG. 7, a tail cone 174*b* is provided having a configuration generally comprising a dome or spherical shape, i.e., a portion of a sphere. The tail cone 174*b* includes an upstream end 176*b* receiving the centerbody gas flow 189 and a radially inwardly inclined or curved surface 175*b* comprising a dome or spherical shape extending toward a downstream end 178*b*. The centerbody gas flow 189 may operate to draw the exhaust flow 154 radially inwardly as it flows along the surface 175*b* from the upstream end 176*b* toward the downstream end 178*b*, as described above with reference to FIG. 5. As the flow reaches the downstream end 178*b*, it may separate from the downstream end 178*b* with a reduced wake downstream of the tail cone 174*b*. The dome or spherical shape of the tail cone 174*b* may function to reduce the strength of the wake at or downstream of the tail cone 174*b* in order to avoid adversely affecting the divergence of the exhaust flow at the second diverging region 186 of the outer boundary 156.

The configurations illustrated in FIGS. 6 and 7 may be provided with an outer boundary 156 such as is described above with regard to FIG. 5. That is, the outer boundary 156 may have a configuration to direct at least a portion of the exhaust gas radially inwardly toward the hub structure 167. For example, the outer boundary 156 may have a radially innermost point of the region 182*b*, such as is depicted for the region 182 in FIG. 5, and the tail cone 174*a*, 174*b* may be axially aligned with the radially innermost point 188.

It may be noted that the tail configurations of FIGS. 6 and 7 may facilitate further reducing the length of the diffuser section 150. By providing a reduced length tail cone 174*a*, 174*b* while effectively closing the wake downstream of the tail cone 174*a*, 174*b*, additional losses of total pressure may be reduced, contributing to greater efficiency in static pressure recovery.

It will be appreciated that an exhaust diffuser system according to the above described aspects of the invention can provide significant benefits. For instance, the power and efficiency of a gas turbine engine can be increased by raising the static pressure recovery of the exhaust diffuser. Further, the need for a long hub without incurring a pressure recovery penalty can be minimized, and possibly eliminated. In addition, the loss in total pressure incurred by flow in an annular diffuser at the end of the hub can be reduced. Hence, an exhaust diffuser configured according to the above described aspects of the invention can achieve the performance of a long hub system while enjoying the costs of a short hub system.

Figure 8:
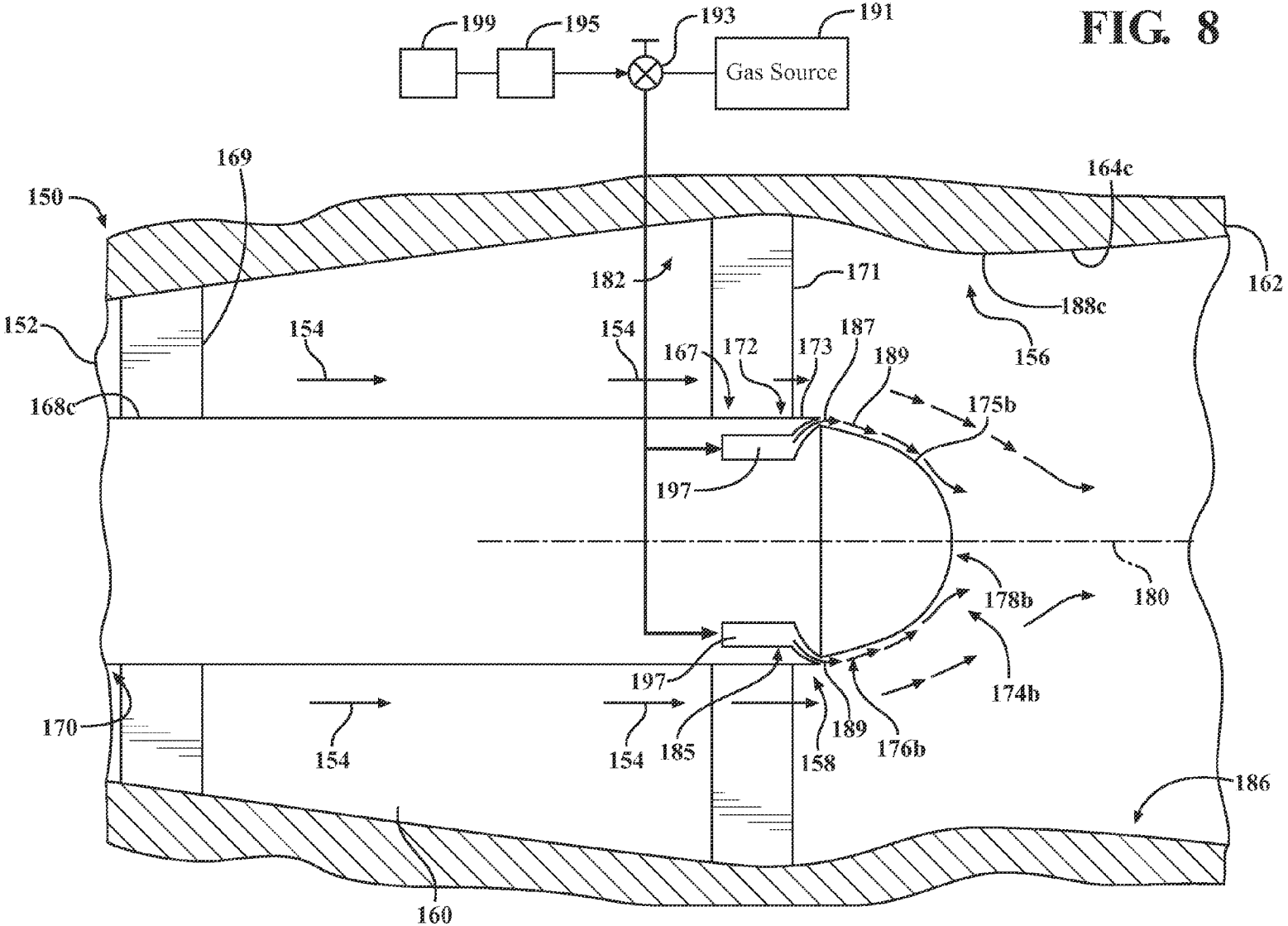
FIG. 8 is a side elevation cross-sectional view of an exhaust diffuser section of a turbine engine configured in accordance with aspects of the invention, including the Coanda jet configuration of FIG. 7 and comprising an alternative long configuration for the hub.
Figure 8A:
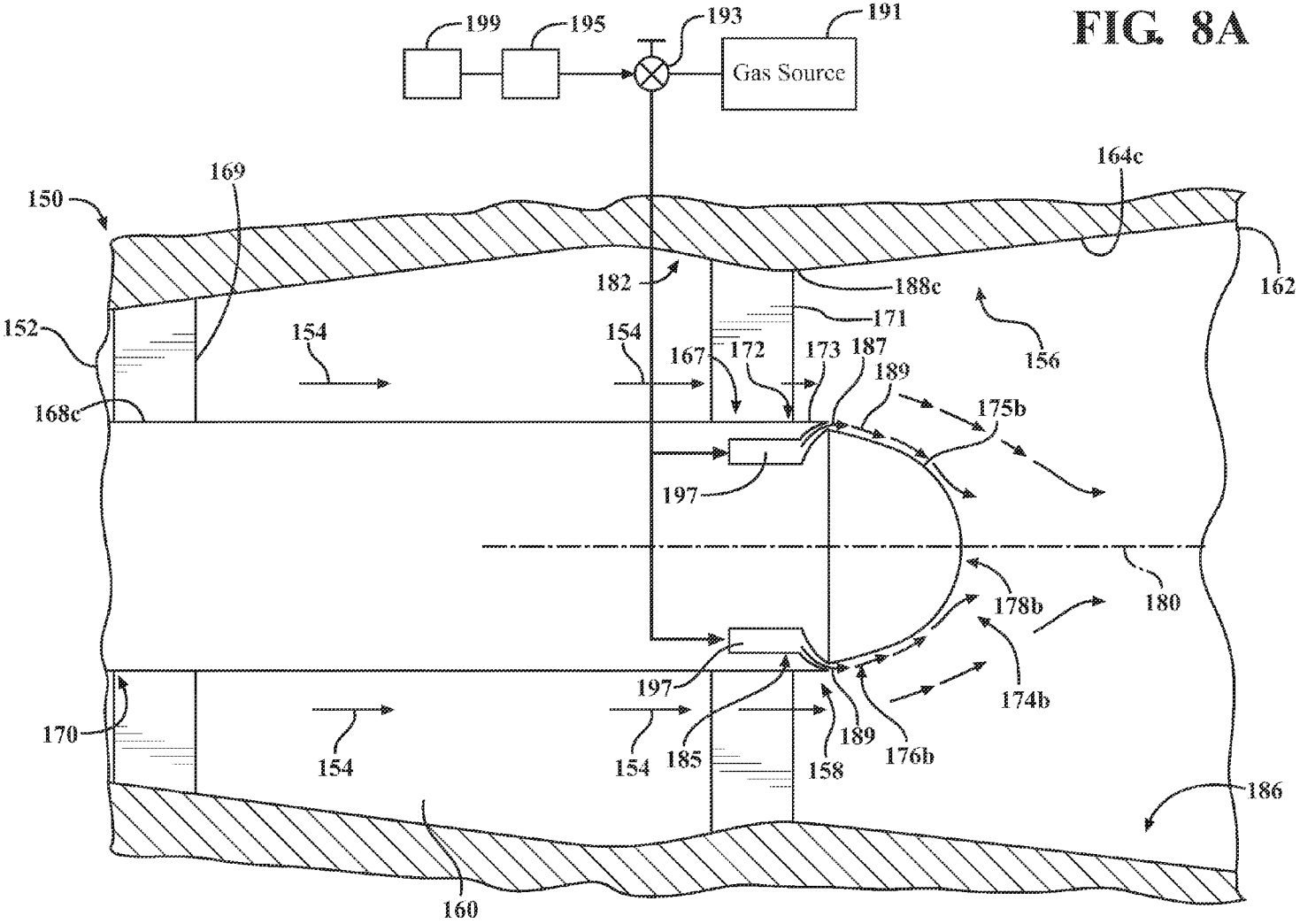
FIG. 8A is a side elevation cross-sectional view similar to FIG. 8 with an innermost point of an outer diffuser boundary illustrated at an upstream location.

Referring to FIGS. 8 and 8A, further aspects of the invention are illustrated comprising an alternative configuration of the aspects described with reference to FIGS. 5-7. In the aspects illustrated in both FIGS. 8 and 8A, an alternative hub structure 167*c* is provided including an extended or long hub 168*c*, and incorporating the tail cone 174*b* described with reference to FIG. 7. However, it should be understood that the present aspects of the invention are not limited to a particular tail cone, such that the tail cones 174, 174*a* described with reference to FIGS. 5 and 6, or other tail cones, may also be used in the present configuration.

The aspects of the invention illustrated in FIGS. 8 and 8A provide a configuration in which the length of the hub 168*c* is substantially longer than the radius of the hub 168*c*, and the length of the tail cone 174*b* is substantially less than that of the hub 168*c*, in contrast to aspects described above. However, the present aspects of the invention provide improved performance for longer exhaust diffuser sections 150 than those described in the preceding embodiments. Also, the long exhaust diffuser section 150 may necessitate provision of downstream support struts 171 to provide further support for the additional length of the hub structure 168*c*.

In the configuration of FIG. 8, it may be noted that the radially innermost point 188*c* of the region 182 is located at an axial location substantially similar to that described above for aspects of the invention illustrated in FIGS. 2-7. Specifically, the radially inner most point 188*c* of the region 182 generally may be located substantially aligned with the downstream end 178*b* of the tail cone 174*b*, or may be located proximately upstream of the downstream end 178*b* of the tail cone 174*b*.

FIG. 8A illustrates an exemplary alternative location of the radially innermost point 188*c* of the region 182 positioned slightly upstream of the upstream end 176*b* of the tail cone 174*b*. It may be desirable to provide an upstream location of the innermost point 188*c* along the tail cone 174*b*, i.e., closer to the upstream end 176*b* of the tail cone 174*b*, in a diffuser section 150 having a long hub design and in which a larger spacing is provided between the outer boundary 156 and the inner boundary 158. It should be understood that for any of the aspects of the invention described above with regard to FIGS. 2-8 and 8A, the axial location of the innermost point 188*c* of the region 182 may be adjusted, such as within a range between the locations illustrated in FIGS. 8 and 8A, depending on various design factors including, for example, the radial size, shape and length of the exhaust diffuser section 150, and the design velocity for exhaust gas passing through the exhaust diffuser section 150, as well as any other factors affecting flow through the exhaust diffuser section 150.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An exhaust diffuser for a turbine engine comprising:

an inner boundary;

an outer boundary defined by a diffuser shell, the outer boundary being radially spaced from the inner boundary so that a flow path for guiding an exhaust flow is defined therebetween, the outer boundary having a radially inwardly extending region in which the outer boundary extends radially inwardly toward the inner boundary; and at least one gas jet including a jet exit located on the inner boundary, upstream from a downstream end of the inner boundary, the downstream end of the inner boundary extending radially inwardly in a downstream direction from the jet exit, the jet exit discharging a flow of gas downstream substantially parallel to an outer surface of the inner boundary, wherein the flow of gas exits the gas jet in the downstream direction tangential to the inner boundary at a velocity greater than a local exhaust flow velocity in the diffuser at the jet exit to produce a Coanda effect and to direct a portion of the exhaust flow in the diffuser toward the inner boundary.

2. The exhaust diffuser of claim 1, wherein the inner boundary comprises a tail cone including a radially inwardly curved surface, and the flow of gas from the jet exit producing the Coanda effect entrains and accelerates a portion of the exhaust flow to turn radially inwardly, resulting in substantially attached flow around the curvature of the tail cone.

3. The exhaust diffuser of claim 1, including a flow control device to vary the mass flow rate of the gas jet to either increase or decrease the portion of the exhaust flow directed toward the inner boundary.

4. The exhaust diffuser of claim 1, wherein the jet exit comprises an annular slot formed around a periphery of the inner boundary.

5. The exhaust diffuser of claim 1, wherein the radially inwardly extending region begins at a point that is one of substantially aligned with and proximately upstream of the downstream end of the inner boundary, whereby the outer boundary directs at least a portion of the exhaust flow in the diffuser toward the inner boundary.

6. The exhaust diffuser of claim 1, wherein the inner boundary includes a tail cone and the flow path has an associated total flow area that varies along the length of the exhaust diffuser, and the radially inwardly extending region causes a decrease in the total flow area in the area of the tail cone.

7. The exhaust diffuser of claim 6, wherein the radially inwardly extending region directs the exhaust flow radially inwardly to an area of minimum area of the exhaust flow, and the area of minimum area of the exhaust flow is at a location that is one of substantially aligned with and proximately upstream of the downstream end of the tail cone.

8. An exhaust diffuser for a turbine engine comprising:

an inner boundary defined by a hub structure comprising at least a hub and a tail cone;

the hub having an upstream end and a downstream end;

the tail cone having an upstream end located adjacent the downstream end of the hub and including a downstream end, and the tail cone tapering radially inwardly toward an axis of the diffuser;

an outer boundary defined by a diffuser shell, the outer boundary being radially spaced from the inner boundary so that a flow path for guiding an exhaust flow is defined therebetween, the outer boundary having a region in which the outer boundary extends radially inwardly toward the inner boundary, wherein the region begins at a point that is one of substantially aligned with and proximately upstream of the downstream end of the hub structure, whereby the outer boundary directs at least a portion of an exhaust flow in the diffuser toward the hub structure; and at least one gas jet including a jet exit located on the hub structure adjacent to the upstream end of the tail cone, the jet exit discharging a flow of gas downstream substantially parallel to an outer surface of the tail cone to direct an additional portion of the exhaust flow toward the hub structure.

9. The exhaust diffuser of claim 8, wherein the tail cone comprises a radially inwardly curved surface and the flow of gas from the jet exit produces a Coanda effect to entrain and accelerate a portion of the exhaust flow to turn radially inwardly in substantially attached flow around the curvature of the tail cone.

10. The exhaust diffuser of claim 9, wherein a slope measured on a surface of the tail cone increases in a direction from an upstream end to a downstream end of the tail cone.

11. The exhaust diffuser of claim 9, wherein the tail cone comprises a truncated cone.

12. The exhaust diffuser of claim 9, wherein the tail cone comprises a spherical surface.

13. The exhaust diffuser of claim 8, wherein the flow of gas from the jet exit is discharged at a velocity greater than a velocity of the exhaust flow through the diffuser.

14. The exhaust diffuser of claim 8, wherein said jet exit comprises an annular slot formed around a periphery of the hub structure.

15. A method of exhaust diffusion in a turbine engine comprising the steps of:

providing a turbine engine having a turbine section and an exhaust diffuser section, the exhaust diffuser section including an inner boundary defined at least by a hub structure comprising at least a hub and a tail cone, the hub having an upstream end and a downstream end, the tail cone having an upstream end located adjacent the downstream end of the hub and a downstream end, and the tail cone tapering radially inwardly toward an axis of the diffuser, the exhaust diffuser section further including an outer boundary radially spaced from the inner boundary so that a flow path is defined therebetween, the outer boundary comprising a region in which the outer boundary extends radially inwardly toward the inner boundary;

supplying turbine exhaust gas flow to the flow path;

the region of the outer boundary directing at least a portion of the exhaust flow toward the hub structure;

providing a Coanda jet flow adjacent the upstream end of the tail cone to effect a radially inward flow of at least a portion of the exhaust gas flow toward the tail cone; and determining a condition affecting at least one property of the exhaust gas flow supplied to an inlet of the exhaust diffuser section and corresponding to a non-uniform velocity profile of the exhaust gas flow between the outer boundary and the inner boundary, and changing the Coanda jet flow in response to a change in the at least one property of the exhaust gas flow supplied to the inlet of the exhaust diffuser section, wherein the condition affecting the at least one property of the exhaust gas flow supplied to the inlet of the exhaust diffuser section comprises at least one of:

a) an ambient temperature of air entering the turbine engine; and b) a change in power output of the turbine engine.

16. The method claim 15, including measuring a change in the ambient temperature of air entering the turbine engine and changing a flow rate or a velocity of the Coanda jet flow in response to the change in ambient air temperature.

* * * * *